United States Patent [19]

Adam et al.

[11] Patent Number: 4,878,967

[45] Date of Patent: Nov. 7, 1989

[54] RAPIDLY SOLIDIFIED ALUMINUM BASED, SILICON CONTAINING ALLOYS FOR ELEVATED TEMPERATURE APPLICATIONS

[75] Inventors: Colin M. Adam; Richard L. Bye, both of Morristown; Santosh K. Das, Randolph; David J. Skinner, Long Valley, all of N.J.

[73] Assignee: Allied-Signal Inc., Morris Township, Morris County, N.J.

[21] Appl. No.: 96,293

[22] Filed: Sep. 8, 1987

Related U.S. Application Data

[63] Continuation of Ser. No. 782,774, Oct. 2, 1985, abandoned.

[51] Int. Cl.[4] ..... C22C 21/00

[52] U.S. Cl. ..... 148/437; 75/249; 419/28; 419/48; 419/60; 419/66; 419/67

[58] Field of Search ..... 148/437–440, 148/415–418; 420/548, 550, 551, 552, 553; 75/249; 419/28, 48, 50, 60, 66–69

[56] References Cited

U.S. PATENT DOCUMENTS 4,347,076 8/1982 Ray et al. ..... 148/437

FOREIGN PATENT DOCUMENTS 0100287 7/1983 European Pat. Off. .
0136508 8/1984 European Pat. Off. .
0143727 11/1984 European Pat. Off. .

*Primary Examiner*—R. Dean
*Attorney, Agent, or Firm*—Ernest D. Buff; Gerhard H. Fuchs

[57] ABSTRACT

A rapidly solidified aluminum-base alloy consists essentially of the formula $Al_{bal}Fe_aSi_bX_c$, wherein X is at least one element selected from the group consisting of Mn,V,Cr,Mo,W,Nb,Ta, "a" ranges from 2.0 to 7.5 atom percent, "b" ranges from 0.5 to 3.0 atom percent, "c" ranges from 0.05 to 3.5 atom percent and the balance is aluminum plus incidental impurities, with the proviso that the ratio {Fe+X}:Si ranges from about 2.0:1 to 5.0:1. The alloy exhibits high strength, ductility and fracture toughness and is especially suited for use in high temperature structural applications such as gas turbine engines, missiles, airframes and landing wheels.

12 Claims, 8 Drawing Sheets

ALLOY: $Al_{93.47}Fe_{3.33}Mn_{1.68}Si_{1.52}$ (at %)
LATTICE: a = 1.2608 nm.
PARAMETER
STRUCTURE: BODY-CENTERED CUBIC (bcc)
AL: ALUMINUM MATRIX )
AFS: $Al_{12}(Fe,X)_3$ Si DISPERSOID )
(xyz): LATTICE PLANE THAT IS DIFFRACTING X-RAYS.

RAPIDLY SOLIDIFIED ALUMINUM BASED, SILICON CONTAINING ALLOYS FOR ELEVATED TEMPERATURE APPLICATIONS

This application is a continuation of application Ser. No. 782,774 filed Oct. 2, 1985, abandoned.

BACKGROUND OF THE INVENTION

1. Field of the Invention

The invention relates to aluminum based, Silicon containing, alloys having strength, ductility and toughness at ambient and elevated temperatures and relates to powder products produced from such alloys. More particularly, the invention relates to Al-Fe-Si alloys that have been rapidly solidified from the melt and thermomechanically processed into structural components having a combination of high strength, ductility and fracture toughness.

2. Brief Description of the Prior Art

Methods for obtaining improved tensile strength at 350° C. in aluminum based alloys have been described in U.S. Pat. No. 2,963,780 to Lyle, et al.; U.S. Pat. No. 2,967,351 to Roberts, et al.; and U.S. Pat. No. 3,462,248 to Roberts, et al. The alloys taught by Lyle, et al. and by Roberts, et al. were produced by atomizing liquid metals into finely divided droplets by high velocity gas streams. The droplets were cooled by convective cooling at a rate of approximately $10^{4°}$ C./sec. As a result of this rapid cooling, Lyle, et al. and Roberts, et al. were able to produce alloys containing substantially higher quantities of transition elements than had therefore been possible.

Higher cooling rates using conductive cooling, such as splat quenching and melt spinning, have been employed to produce cooling rates of about $10^{5°}$ to $10^{6°}$ C./sec. Such cooling rates minimize the formation of intermetallic precipitates during the solidification of the molten aluminum alloy. Such intermetallic precipitates are responsible for premature tensile instability. U.S. Pat. No. 4,379,719 to Hildeman, et al. discusses rapidly quenched aluminum alloy powder containing 4 to 12 wt % iron and 1 to 7 wt % cerium or other rare earth metal from the lanthanum series.

U.S. Pat. No. 4,347,076 to Ray, et al. discusses high strength aluminum alloys for use at temperatures of about 350° C. that have been produced by rapid solidification techniques. These alloys, however, have low engineering ductility and fracture toughness at room temperature which precludes their employment in structural applications where a minimum tensile elongation of about 3% is required. An example of such an application would be in small gas turbine engines discussed by P.T. Millan, Jr.; Journal of Metals, Volume 35 (3), page 76, 1983.

Ray, et al. discusses aluminum alloys composed of a metastable, face-centred cubic, solid solution of transition metal elements with aluminum. The as cast ribbons were brittle on bending and were easily comminuted into powder. The powder was compacted into consolidated articles having tensile strengths of up to 76 ksi at room temperature. The tensile ductility or fracture toughness of these alloys was not discussed in detail in Ray, et al. However, it is known that (NASA REPORT NASi-17578 May 1984) many of the alloys taught by Ray, et al., when fabricated into engineering test bars do not posses sufficient room temperature ductility or fracture toughness for use in structural components.

Thus, conventional aluminum alloys, such as those taught by Ray, et al. have lacked sufficient engineering toughness. As a result, these conventional alloys have not been suitable for use in structural components.

SUMMARY OF THE INVENTION

The invention provides an aluminum based alloy consisting essentially of the formula $Al_{bal}Fe_aSi_bX_c$, wherein X is at least one element selected from the group consisting of Mn, V, Cr, Mo, W, Nb, Ta, "a" ranges from 2.0 to 7.5 at %, "b" ranges form 0.5 to 3.0 at %, "c" ranges from 0.05 to 3.5 at % and the balance is aluminum plus incidental impurities, with the proviso that the ratio {Fe+X}:Si ranges from about 2.0:1 to 5.0:1.

To provide the desired levels of ductility, toughness and strength needed for commercially useful applications, the alloys of the invention are subjected to rapid solidification processing, which modifies the alloy microstructure. The rapid solidification processing method is one wherein the alloy is placed into the molten state and then cooled at a quench rate of at least about $10^{5°}$ to $10^{7°}$ C./sec. to form a substance. Preferably this method should cool the molten metal at a rate of greater than about $10^{6°}$ C./sec, ie. via melt spinning, spat cooling or planar flow casting which forms a solid ribbon or sheet. These alloys have an as cast microstructure which varies from a microeutectic to a microcellular structure, depending on the specific alloy chemistry. In alloys of the invention the relative proportions of these structures is not critical.

Consolidated articles are produced by compacting particles composed of an aluminum based alloy consisting essentially of the formula $Al_{bal}Fe_aSi_bX_c$, wherein X is at least one element selected from the group consisting of Mn, V, Cr, Mo, W, Nb, Ta, "a" ranges from 2.0 to 7.5 at %, "b" ranges from 0.5 to 3.0 at %, "c" ranges from 0.05 to 3.5 at % and the balance is aluminum plus incidental impurities, with the proviso that the ratio {Fe+X}:Si ranges from about 2.0:1 to 5.0:1. The particles are heated in a vacuum during the compacting step to a pressing temperataure varying from about 300 to 500° C., which minimizes coarsening of the dispersed, intermetallic phases. Alternatively, the particles are put in a can which is then evacuated, heated to between 300° C. and 500° C., and then sealed. The sealed can is heated to between 300° C. and 500° C. in ambient atmosphere and compacted. The compacted article is further consolidated by conventionally practiced methods such as extrusion, rolling or forging.

The consolidated article of the invention is composed of an aluminum solid solution phase containing a substantially uniform distribution of dispersoid intermetallic phase precipitates of approximate composition $Al_{12}(Fe, X)_3Si$. These precipitates are fine intermetallics measuring less than 100nm. in all linear dimensions thereof. Alloys of the invention, containing these fine dispersed intermetallics are able to tolerate the heat and pressure associated with conventional consolidation and forming techniques such as forging, rolling, and extrusion without substantial growth or coarsening of these intermetallics that would otherwise reduce the strength and ductility of the consolidated article to unacceptably low levels. Because of the thermal stability of the dispersoids in the alloys of the invention, the alloys can be used to produce near net shape articles, such as wheels, by forging, semi-finished articles, such as T-sections, by extrusion, and plate or sheet products by rolling that have a combination of strength and good ductility both at ambient temperature and at elevated temperatures of about 350° C.

Thus, the articles of the invention are more suitable for high temperature structural applications such as gas turbine engines, missiles, airframes, landing wheels etc.

BRIEF DESCRIPTION OF THE DRAWINGS

The invention will be more fully understood and further advantages will become apparent when reference is made to the following detailed description of the prefered embodiment of the invention and the accompanying drawings in which:

FIG. 3(*b*) shows a transmission electron micrograph of a consolidated article not contained in the invention, alloy 452 ($Al_{92.8}Fe_{5.61}V_{1.59}$).

DETAILED DESCRIPTION OF THE INVENTION AND THE PREFERRED EMBODIMENTS

To provide the desired levels of strength, ductility and toughness needed for commercially useful applications, rapid solidification from the melt is particularly useful for producing these aluminum based alloys. The alloys of the invention consist essentially of the formula $Al_{bal}Fe_aSi_bX_c$, wherein X is at least one element selected from the group consisting of Mn, V, Cr, Mo, W, Nb, Ta, "a" ranges from 2.0 to 7.5 at %, "b" ranges from 0.5 to 3.0 at %, "c" ranges from 0.05 to 3.5 at % and the balance is aluminum plus incidental impurities, with the proviso that the ratio {Fe+X}:Si ranges from about 2.0:1 to 5.0:1. The rapid solidification processing typically employs a casting method wherein the alloy is placed into a molten state and then cooled at a quench rate of at least about $10^{5°}$ to $10^{7°}$ C./sec. on a rapidly moving casting substrate to form a solid ribbon or sheet. This process should provide provisos for protecting the melt puddle from burning, excessive oxidation and physical disturbances by the air boundary layer carried with along with a moving casting surface. For example, this protection can be provided by a shrouding apparatus which contains a protective gas; such as a mixture of air or $Co_2$ and $SF_6$, a reducing gas, such as CO or an inert gas; around the nozzle. In addition, the shrouding apparatus excludes extraneous wind currents which might disturb the melt puddle.

Figure 1:
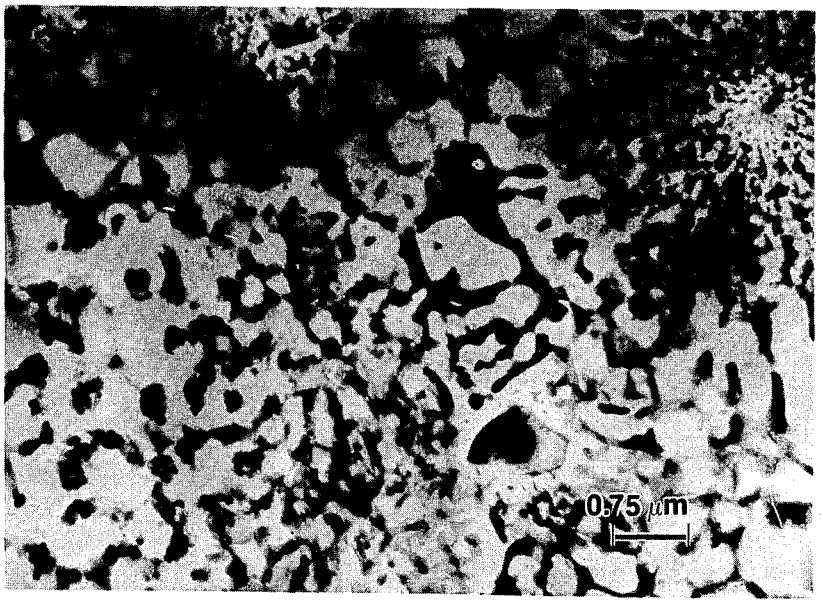
FIG. 1 Shows a transmission electron micrograph of an as-cast ($Al_{93.67}Fe_{3.98}V_{0.82}Si_{1.53}$ alloy of the invention.

As representatively shown in FIG. 1, the as-cast alloy of the present invention may have a microeutectic microstructure or a microcellular microstructure.

Rapidly solidified alloys having the $Al_{bal}Fe_aSi_bX_c$ composition (with the {Fe+X}:Si ratio proviso) described above have been processed into ribbons and then formed into particles by conventional comminution devices such as pulverizers, knife mills, rotating hammer mills and the like. Preferably, the comminuted powder particles have a size ranging from about −40 to 200 mesh, US standard sieve size.

The particles are placed in a vacuum of less than $10^{-4}$ torr ($1.33\times10^{-2}$ Pa.) preferably less than $10^{-5}$ torr ($1.33\times10^{-3}$ Pa.), and then compacted by conventional powder metallurgy techniques. In addition the particles are heated at a temperature ranging from about 300° to 550° C., preferably ranging from about 325° to 450° C., minimizing the growth or coarsening of the intermetallic phases therein. The heating of the powder particles preferably occurs during the compacting step. Suitable powder metallurgy techniques include direct powder extrusion by putting the powder in a can which has been evacuated and sealed under vacuum, vacuum hot compaction, blind die compaction in an extrusion or forging press, direct and indirect extrusion, conventional and impact forging, impact extrusion and combinations of the above.

Figure 2:
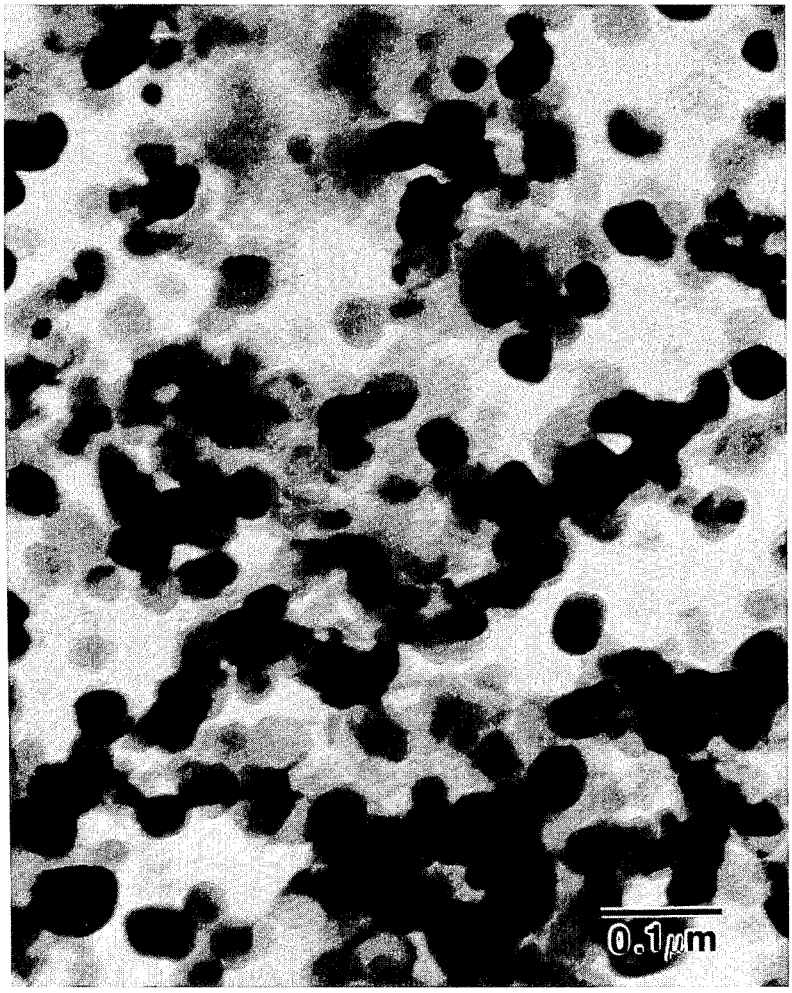
FIG. 2 shows a transmission electron micrograph of a consolidated article of the invention (alloy $Al_{93.6-7}Fe_{3.98}V_{0.82}Si_{1.53}$).
Figure 3A:
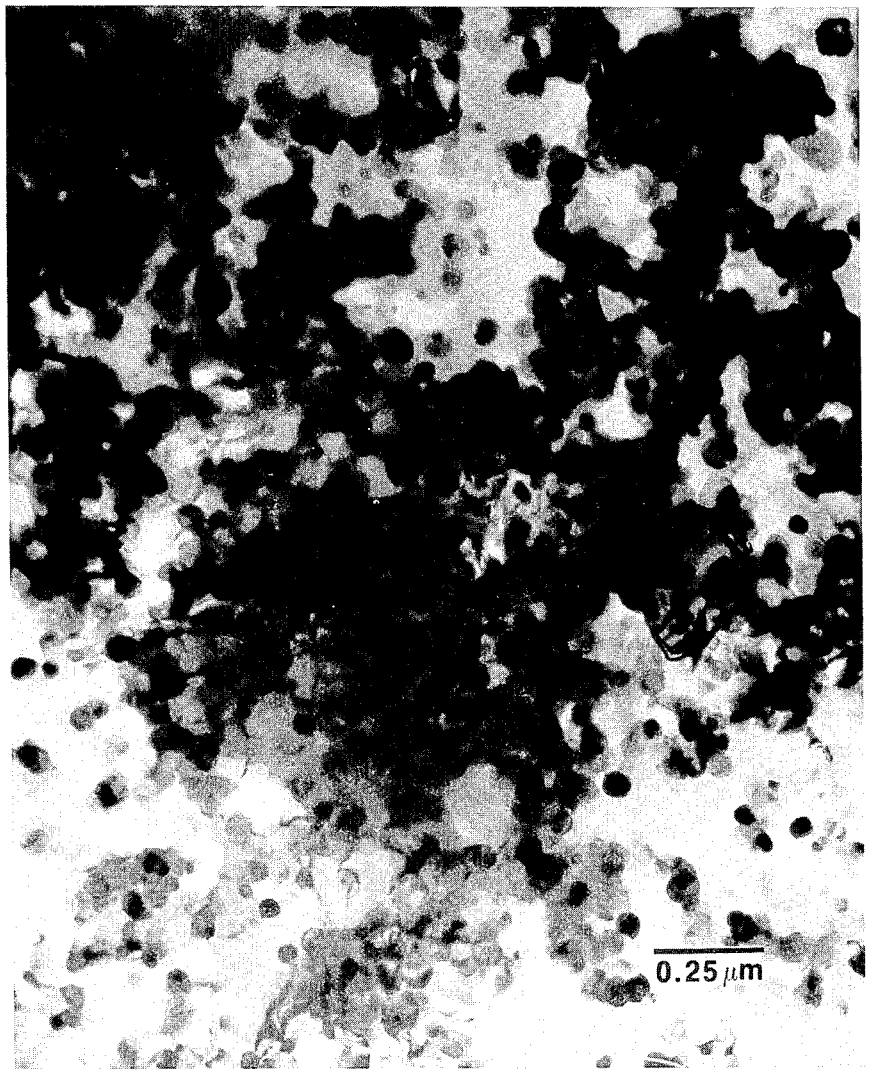
FIG. 3(*a*) shows a transmission electron micrograph of the consolidated article of the invention, alloy 452S ($Al_{90.99}Fe_{5.61}V_{1.59}Si_{1.81}$).
Figure 3B:
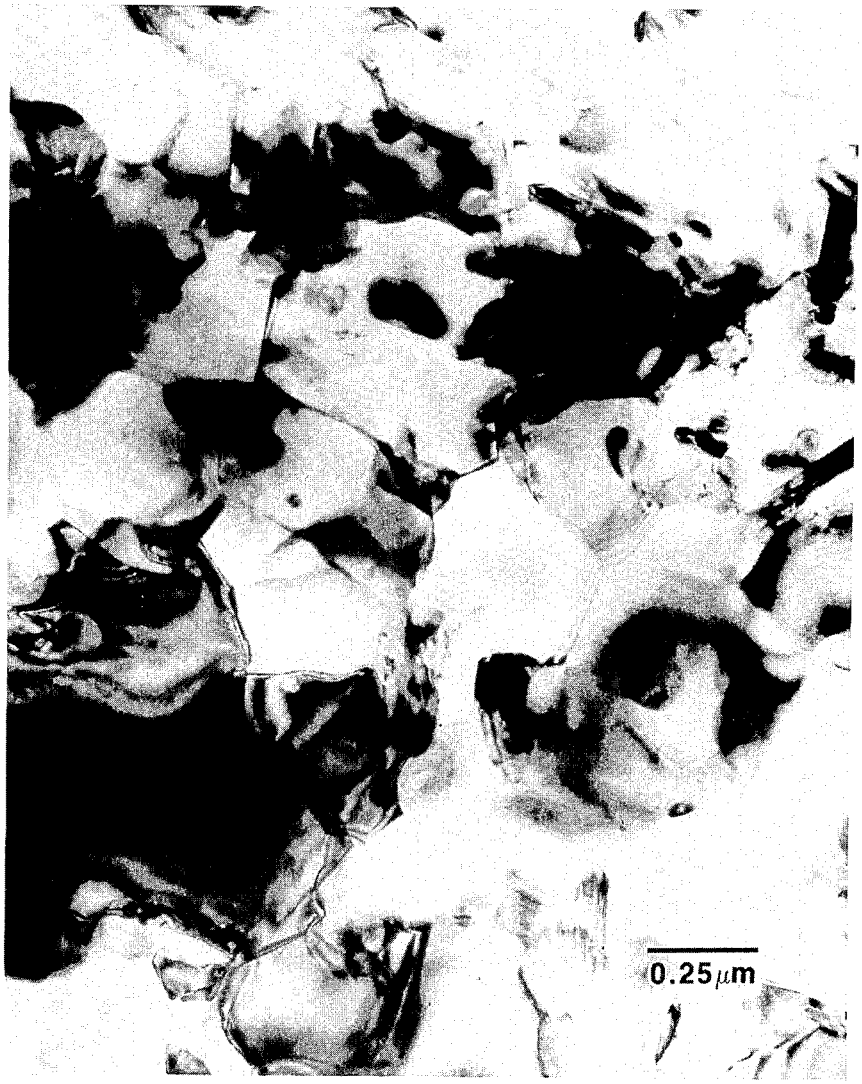

As representatively shown in FIG. 2, the compacted consolidated article of the invention is composed of a substantially homogeneous dispersion of very small intermetallic phase precipitates within the aluminum solid solution matrix. With appropriate thermomechanical processing these intermetallic precipitates can be provided with optimized combinations of size, eg. diameter, and interparticle spacing. These characteristics afford the desired combination of high strength and ductility. The precipitates are fine, usually sperical in shape, measuring less than about 100nm. in all linear dimentions thereof. The volume fraction of these fine intermetallic precipitates ranges from about 10 to 50%, and preferably, ranges from about 20 to 35% to provide improved properties. Volume fractions of coarse intermetallic precipitates (ie. precipitates measuring more than about 100nm. in the largest dimention thereof) is not more than about 1%. Further reference to FIG. 3(*a*) shows a transmission electron micrograph of a consolidated article of the invention (with composition $Al_{90.9-9}Fe_{5.61}V_{1.59}Si_{1.81}$) that contains a substantially homogeneous dispersion of very small intermetallic phase precipitates, these dispersed intermetallic precipitates are generally spherical in shape and measure less than 100 nm. in all dimensions thereof. Contrastingly, FIG. 3(*b*) shows a transmission electron micrograph of a consolidated article of the same composition as shown in FIG. 3(*a*) except that the Si content is zero (composition $Al_{92.8}Fe_{5.61}V_{1.59}$), and therefore outside the scope of the invention. The micrograph shows a dispersion of intermetallic phase precipitates that have different compositions than those shown in FIG. 3(*a*). These dispersed intermetallic precipitates are generally polygonal or needle shaped and of a size such that they are deleterious to the mechanical properties (strength, ductility).

Figure 4:
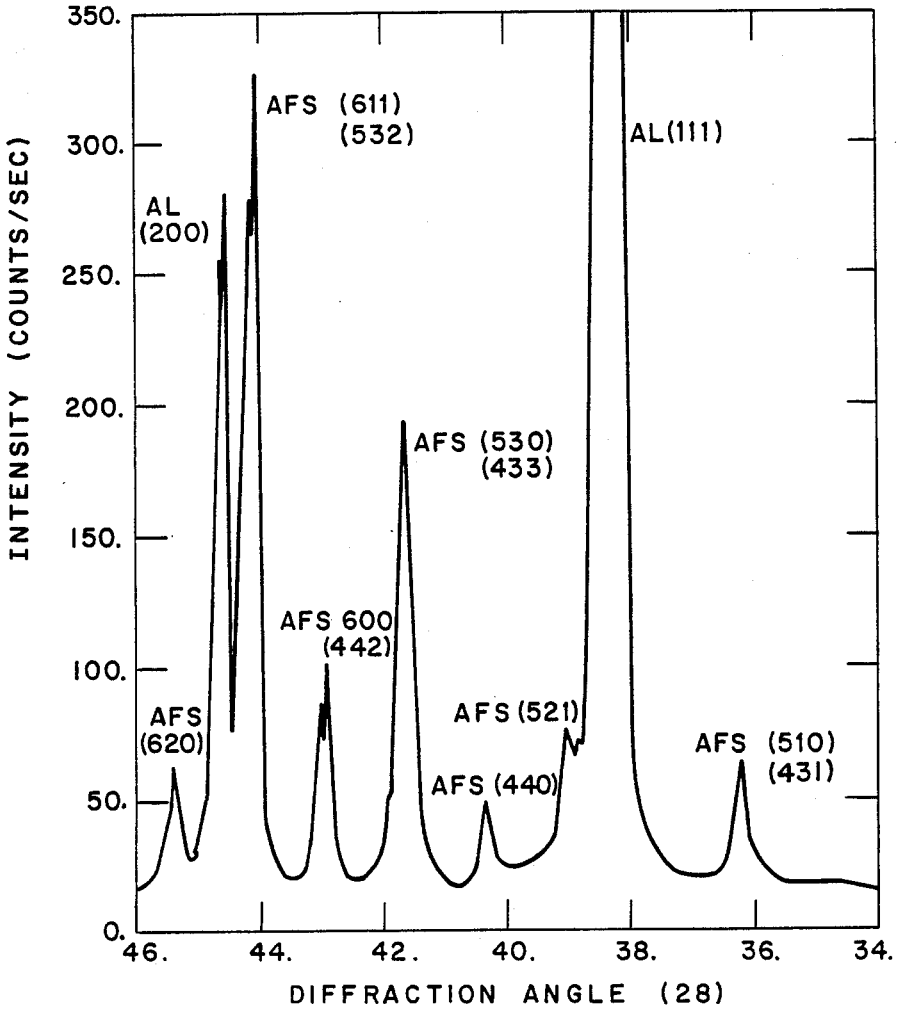
FIG. 4 shows a partial X-ray diffractometer tracing recording the presence of the preferred intermetallic phase precipitate described in the invention contained within the aluminum matrix.
Figure 5:
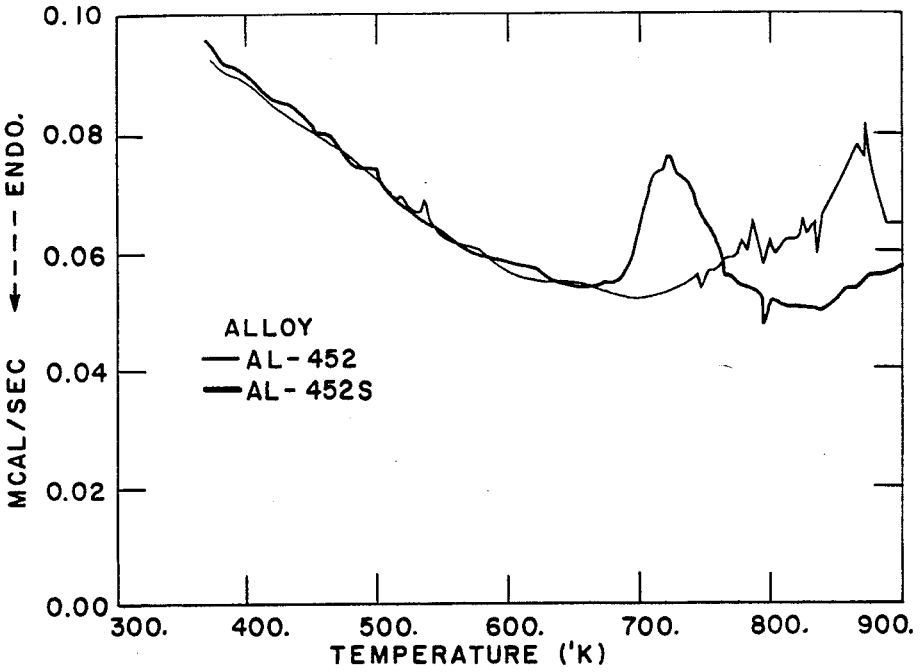
FIG. 5 shows a differential scanning calorimetry tracing of two alloys, one (alloy 452) which is outside the scope of the invention, the other (alloy 452S) is described by the invention, recording the difference in intermetallic precipitation sequence between these two alloys.

Compositions of the fine intermetallic precipitates found in the consolidated article of the invention is approximately $Al_{12}(Fe,X)_3Si$. For alloys of the invention this intermetallic composition represents about 80% of the fine dispersed intermetallic precipitates found in the consolidated article. The addition of one or more of the elements listed as X when describing the alloy composition as the formula $Al_{bal}Fe_aSi_bX_c$ (with the {Fe+X}:Si ratio of 2:1 to 5:1) stabilize this metastable ternary intermetallic precipitate resulting in a general composition of about $Al_{12}(Fe, X)_3Si$. To distinguish this intermetallic precipitate from ones with compositions close to this, reference is made to FIG. 4. The partial X-ray diffraction trace reveals the structure and lattice parameter of the intermetallic phase precipitate and of the aluminum matrix of a consolidated article of the invention. The prefered stabilized intermetallic precipitate has a structure that is cubic (either body-centered or primative cubic) and a lattice parameter that is about 1.25 to 1.28nm. Further FIG. 5 reveals the essential difference between alloys of the invention (Si containing alloys) and those outside the scope of the invention. The differential scanning calorimetry trace shows the decomposition of the as-cast structure of alloy $Al_{90.99}Fe_{5.61}V_{1.59}Si_{1.81}$ of the invention; (peak labled "A") into the preferred intermetallic precipitate of composition about $Al_{12}(Fe, V)_3Si$. The other DSC trace shows the decomposition of an as-cast $Al_{92.8}Fe_{5.61}V_{1.59}$ alloy outside the scope of the invention; (peaks labled "B" and "C") into the poygonal and needle shaped precipitates that are deleterious to the mechanical properties.

Figure 6:
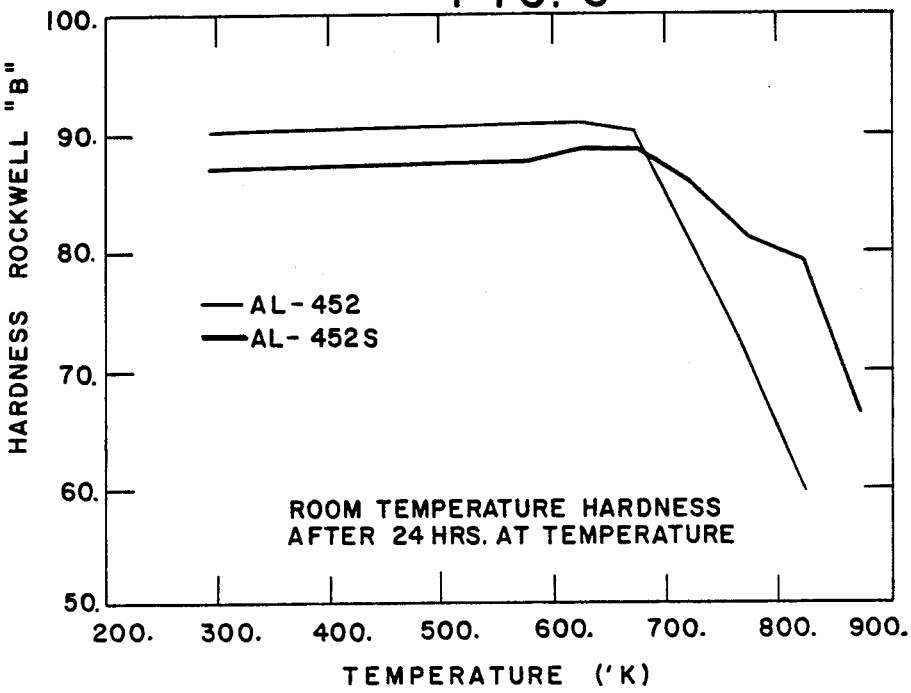
FIG. 6 shows a plot of Rockwell B hardness vs. temperature, demonstrating the increased thermal stability of consolidated article of the invention as compared to a consolidated article outside the scope of the invention.

Alloys of the invention, containing this fine dispersed intermetallic precipitate, are able to tolerate the heat and pressure of conventional powder metallurgy techniques without excessive growth or coarsening of the intermetallics that would otherwise reduce the strength and ducility of the consolidated article to unacceptably low levels. In addition, alloys of the invention are able to withstand unconventionally high processing temperatures and withstand long exposure times at high temperatures during processing. Such temperatures and times are encountered during the production at near net-shape articles by forging and sheet or plate by rolling, for example. Reference to FIG. 6 illustrates the difference in thermal stability of a consolidated article of the invention (Al-Fe-V-Si alloy) and a consolidated article outside the scope of the invention (Al-Fe-V alloy). As a result, alloys of the invention are particularly useful for forming high strength consolidated aluminum alloy articles. The alloys are particularly advantageous because they can be compacted over a broad range of consolidation temperatures and still provide the desired combinations of strength and ductility in the compacted article.

The following examples are presented to provide a more complete understanding of the invention. The specific techniques, conditions, materials, proportions and reported data set forth to illustrate the principles of the invention are exemplary and should not be construed as limiting the scope of the invention.

EXAMPLES 1 to 34

Alloys of the invention were cast according to the formula and method of the invention and are listed in Table 1.

1. $Al_{95.46}Fe_{3.20}V_{0.32}Si_{1.0}$
2. $Al_{95.04}Fe_{3.56}V_{0.4}Si_{1.0}$
3. $Al_{94.69}Fe_{3.63}V_{0.42}Si_{1.26}$
4. $Al_{94.03}Fe_{4.23}V_{0.44}Si_{1.30}$
5. $Al_{93.62}Fe_{4.45}V_{0.5}Si_{1.53}$
6. $Al_{93.87}Fe_{4.0}V_{1.09}Si_{1.04}$
7. $Al_{94.42}Fe_{3.47}V_{1.08}Si_{1.03}$
8. $Al_{94.94}Fe_{2.96}V_{1.08}Si_{1.02}$
9. $Al_{93.34}Fe_{3.50}V_{1.63}Si_{1.53}$
10. $Al_{93.88}Fe_{3.0}V_{1.62}Si_{1.50}$
11. $Al_{95.46}Fe_{2.98}V_{0.55}Si_{1.02}$
12. $Al_{94.92}Fe_{3.47}V_{0.57}Si_{1.04}$
13. $Al_{94.19}Fe_{3.96}V_{0.54}Si_{1.31}$
14. $Al_{93.67}Fe_{3.98}V_{0.82}Si_{1.53}$
15. $Al_{93.90}Fe_{3.97}V_{1.71}Si_{1.42}$
16. $Al_{92.47}Fe_{3.33}Mn_{1.68}Si_{1.52}$
17. $Al_{93.48}Fe_{3.73}Mn_{1.27}Si_{1.52}$
18. $Al_{93.46}Fe_{3.98}V_{1.04}Si_{1.52}$
19. $Al_{93.49}Fe_{4.15}Mn_{0.84}Si_{1.52}$
20. $Al_{93.48}Fe_{4.48}Mn_{0.57}Si_{1.52}$
21. $Al_{93.4}Fe_{3.31}Cr_{1.77}Si_{1.52}$
22. $Al_{93.47}Fe_{4.12}Cr_{0.89}Si_{1.52}$
23. $Al_{93.52}Fe_{4.48}Cr_{0.48}Si_{1.52}$
24. $Al_{93.52}Fe_{4.63}Cr_{0.33}Si_{1.52}$
25. $Al_{93.50}Fe_{4.71}Cr_{0.27}Si_{1.52}$
26. $Al_{93.45}Fe_{3.88}Mo_{1.13}Si_{1.54}$
27. $Al_{93.47}Fe_{4.37}Mo_{0.63}Si_{1.53}$
28. $Al_{93.47}Fe_{4.66}Mo_{0.34}Si_{1.53}$
29. $Al_{93.46}Fe_{4.73}Mo_{0.28}Si_{1.53}$
30. $Al_{93.44}Fe_{4.85}Mo_{0.19}Si_{1.52}$
31. $Al_{90.71}Fe_{6.12}V_{0.85}Si_{2.32}$
32. $Al_{90.66}Fe_{6.34}V_{0.68}Si_{2.32}$
33. $Al_{89.18}Fe_{7.27}Vo0.85Si_{2.70}$
34. $Al_{90.99}Fe_{5.61}V_{1.59}Si_{1.81}$

EXAMPLE 35

Figure 7:
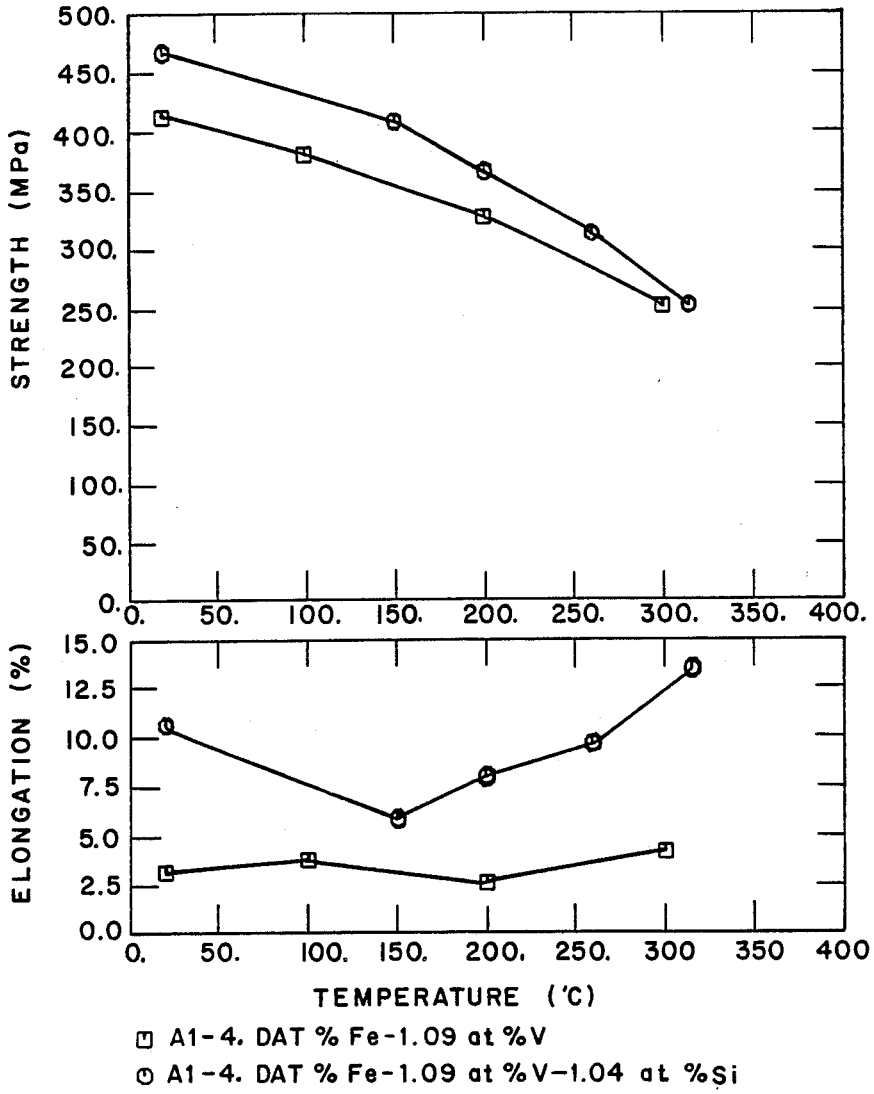
FIG. 7 shows the mechanical property differences between a consolidated article of the invention and a consolidated article that is outside the scope of this invention.

FIG. 7, along with Table 2 below, demonstrates the essential differences between a consolidated article of the invention with one that is outside the scope of the invention. The alloy containing $Al_{93.87}Fe_{4.0}V_{1.09}Si_{1.04}$ when cast and consolidated using the methods of the invention has a microstructure as shown by transmission electron microscopy that exhibits a very fine dispersion of, generally spherical, intermetallic phase precipitates which imparts strength and ductility to the consolidated article of the invention. These very fine intermetallic precipitates are those described in the body of the invention and have a composition that is about $Al_{12}$ (Fe, V)$_3$ Si. The alloy containing $Al_{94.9-1}Fe_{4.0}V_{1.09}$ when cast and consolidated within the conditions of the invention shows a transmission electron microstructure that exhibits polygonal or needle shaped intermetallic precipitates which imparts lower strength and very low ductility.

The mechanical properties shown in Table 2 for both alloys were measured in uniaxial tension at a strain rate of about $5\times10^{-4}$/sec at various elevated temperatures. For both alloys, the as cast ribbons were subjected first to knife milling and then to hammer milling to produce −40 mesh powders. The powders were vacuum hot pressed at 350° C. for 1 hr. to produce 95 to 100% density preform slugs, which were then extruded to form rectangular bars at an extrusion ratio of about 18:1 at 385° C. after holding for 1 hr.

TABLE 2

| ALLOY | TEMPERATURE (°C.) | 0.2% YIELD MPa (ksi) | UTS MPa (ksi) | FRACTURE STRAIN % |
|---|---|---|---|---|
| $Al_{93.87}Fe_{4.0}V_{1.09}Si_{1.04}$ | | | | |
| | 20 | 435 (63.0) | 470 (68.1) | 10.6 |
| | 150 | 394 (57.1) | 412 (59.7) | 6.0 |
| | 200 | 339 (49.1) | 368 (53.3) | 8.1 |
| | 260 | 298 (43.2) | 316 (45.8) | 9.7 |
| | 315 | 243 (35.2) | 255 (36.9) | 13.5 |
| $Al_{94.94}Fe_{4.0}V_{1.09}$ (not of the present invention) | | | | |
| | 20 | 376 (54.5) | 414 (60.0) | 3.2 |
| | 100 | 353 (51.2) | 381 (55.3) | 3.8 |
| | 200 | 317 (46.0) | 329 (47.7) | 2.7 |
| | 300 | 241 (35.0) | 253 (36.7) | 4.2 |

EXAMPLES 36 TO 43

Table 3 below shows the mechanical properties of specific alloys measured in uniaxial tension at a strain rate of approximately $5\times10^{-4}$/sec. and at various elevated temperatures. Each selected alloy powder was vacuum hot pressed at a temperature of 350° C. for 1 hr. to produce a 95 to 100% density preform slug. These slugs were extruded into rectangular bars with an extrusion ratio of 18:1 at 385° to 400° C. after holding at that temperature of 1 hr.

TABLE 3

| EXAMPLE | ALLOY | Ultimate Tensile Strength (UTS) MPa and Elongation to Fracture ($E_f$) % | | | | | |
|---|---|---|---|---|---|---|---|
| | | | TEST TEMPERATURE (°C.) | | | | |
| | | | 20 | 150 | 204 | 260 | 315 |
| 36 | $Al_{93.62}Fe_{4.45}V_{0.5}Si_{1.53}$ | UTS | 459 | 381 | 356 | 306 | 250 |
| | | $E_f$ | 11.8 | 6.7 | 7.4 | 10.1 | 11.0 |
| 37 | $Al_{93.34}Fe_{3.50}V_{1.63}Si_{1.53}$ | UTS | 510 | 437 | 406 | 350 | 281 |
| | | $E_f$ | 11.1 | 6.9 | 5.5 | 8.4 | 13.3 |
| 38 | $Al_{93.67}Fe_{3.98}V_{0.82}Si_{1.53}$ | UTS | 493 | 406 | 367 | 322 | 287 |
| | | $E_f$ | 11.1 | 6.2 | 6.0 | 8.3 | 9.2 |
| 39 | $Al_{93.48}Fe_{4.43}Mn_{0.57}Si_{1.52}$ | UTS | 460 | 388 | 357 | 315 | 239 |
| | | $E_f$ | 9.0 | 5.0 | 5.8 | 6.5 | 14.0 |
| 40 | $Al_{93.5}Fe_{4.71}Cr_{0.27}Si_{1.52}$ | UTS | 470 | 415 | 373 | 320 | 242 |
| | | $E_f$ | 11.0 | 5.4 | 5.6 | 8.7 | 12.1 |
| 41 | $Al_{93.44}Fe_{4.85}Mo_{0.19}Si_{1.52}$ | UTS | 502 | 421 | 409 | 368 | 259 |
| | | $E_f$ | 8.4 | 4.7 | 4.8 | 7.0 | 11.4 |
| | | | TEST TEMPERATURE (°C.) | | | | |
| | | | 20 | 150 | 232 | 343 | |
| 42 | $Al_{90.71}Fe_{6.12}V_{0.86}Si_{2.32}$ | UTS | 651 | 565 | 476 | 294 | |
| | | $E_f$ | 6.8 | 3.4 | 4.1 | 6.0 | |
| | | | TEST TEMPERATURE (°C.) | | | | |
| | | | 20 | 177 | 232 | 288 | 343 |
| 43 | $Al_{90.99}Fe_{5.61}V_{1.59}Si_{1.81}$ | UTS | 562 | 453 | 416 | 351 | 286 |
| | | $E_f$ | 8.3 | 5.0 | 4.8 | 8.7 | 11.0 |

EXAMPLE 44

Selected alloys of the invention are capable of producing consolidated articles which have high strength at very high elevated temperatures e.g. 900° F. Table 4 below shows the elevated strength of an $Al_{90.66}Fe_{6.34}V_{0.68}Si_{2.32}$ alloy article consolidated by vacuum hot compaction at 350° C., and subsequently extruded at 400° C. with an extrusion ratio of 18:1. This alloy has a strength at 900° F. which is 1000% higher than conventional aluminum alloys. This is a further demonstration of the improved thermal stability of the preferred intermetallic precipitate that is formed in the consolidated articles of the invention.

TABLE 4

| EXAMPLE | ALLOY | Ultimate Tensile Strength (UTS) MPa and Elongation to Fracture ($E_f$) % | | | | | | |
|---|---|---|---|---|---|---|---|---|
| | | | TEST TEMPERATURE (°F.) | | | | | |
| | | | 75 | 300 | 450 | 650 | 850 | 900 |
| 44 | $Al_{90.66}Fe_{6.34}Mn_{0.68}Si_{2.32}$ | UTS | 720 | 558 | 531 | 312 | 147 | 126 |
| | | $E_f$ | 5.8 | 2.5 | 3.1 | 6.5 | 8.9 | 18.4 |

EXAMPLES 45 TO 54

The alloys of the invention are capable of producing consolidated articles which have high fracutre toughness when measured at room temperature. Table 5 below shows the fracture toughness for selected consolidated articles of the invention. Each of the powder articles were consolidated by vacuum hot compaction at 350° C. and subsequently extruded at 385° C. at an extrusion ratio of 18:1. Fracture toughness measurements were made on compact tension (CT) specimens of the consolidated articles of the invention under the ASTM E399 standard.

TABLE 5

| EXAMPLE | ALLOY | FRACTURE TOUGHNESS (ksi √in.) |
|---|---|---|
| 45 | $Al_{94.03}Fe_{4.23}V_{0.44}Si_{1.30}$ | 25.5 |
| 46 | $Al_{98.52}Fe_{4.45}V_{0.50}Si_{1.53}$ | 23.7 |
| 47 | $Al_{94.42}Fe_{3.47}V_{1.08}Si_{1.03}$ | 24.5 |
| 48 | $Al_{94.92}Fe_{2.96}V_{1.08}Si_{1.02}$ | 24.6 |
| 49 | $Al_{93.88}Fe_{3.0}V_{1.62}Si_{1.50}$ | 27.8 |
| 50 | $Al_{95.45}Fe_{2.98}V_{0.55}Si_{1.02}$ | 23.8 |
| 51 | $Al_{94.92}Fe_{3.47}V_{0.57}Si_{1.04}$ | 25.4 |
| 52 | $Al_{94.19}Fe_{3.96}V_{0.54}Si_{1.31}$ | 25.9 |
| 53 | $Al_{93.67}Fe_{3.98}V_{0.82}Si_{1.53}$ | 27.5 |
| 54 | $Al_{93.90}Fe_{3.97}V_{0.71}Si_{1.42}$ | 21.6 |

EXAMPLES 55 TO 57

The alloys of the invention are capable of producing consolidated articles which have the form of a sheet having a width of at least 0.5" and a thickness of at least 0.010". Table 6 below shows the room temperature strength and ductility of selected consolidated sheet articles of the invention. Such sheet was produced by vacuum hot pressing powder, followed by forging into approximately ½" thick plate, heating such forged plate to 400° C. and then rolling into 0.10 inch sheet. During this extensive thermal cycling the dispersed intermetallic precipitates may grow somewhat. Under these conditions the size of the dispersed intermetallic precipitates will be less than 500 nm, in any linear dimension thereof.

TABLE 6

| EXAMPLE | ALLOY | TENSILE DATA FOR 0.10" SHEET, AS ROLLED. | | |
|---|---|---|---|---|
| | | YS(MPa) | UTS(MPa) | e(%) |
| 55 | $Al_{93.67}Fe_{3.98}V_{0.82}Si_{1.53}$ | 423 | 464 | 17.8 |
| 56 | $Al_{90.99}Fe_{5.61}V_{1.59}Si_{1.81}$ | 515 | 560 | 9.6 |
| 57 | $Al_{90.66}Fe_{6.34}V_{0.68}Si_{2.32}$ | 573 | 619 | 9.7 |

EXAMPLES 58 TO 59

Table 7 below shows the room temperature mechanical properties of specific alloys of the invention that have been consolidated by forging. Each selected alloy powder was vacuum hot pressed at a temperature of 350° C. for 1 hr. to provide a 95 to 100% density preform slug. These slugs were subsequently forged at a temperature from about 450° C. to 500° C. after holding at that temperature for 1 hr.

TABLE 7

| EXAMPLE | ALLOY | FORGING TEMPERATURE | TENSILE DATA YS (MPa) | UTS (MPa) | e (%) |
|---|---|---|---|---|---|
| 58 | $Al_{93.67}Fe_{3.98}V_{0.82}Si_{1.53}$ | 450° C. | 443 | 475 | 8.1 |
| | | 500° C. | 391 | 428 | 9.8 |
| 59 | $Al_{90.99}Fe_{5.61}V_{1.59}Si_{1.81}$ | 500° C. | 452 | 499 | 7.6 |

EXAMPLE 60

Figure 8:
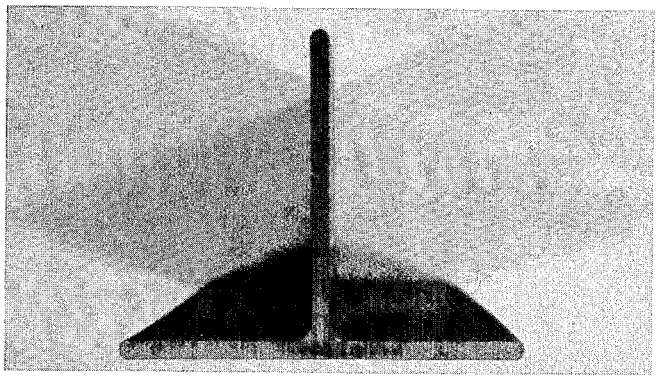
FIG. 8 shows a photograph of a T-section made by extrusion of the alloy of the present invention.

An $Al_{93.67}Fe_{3.98}V_{0.82}Si_{1.53}$ alloy powder of present invention was vacuum hot compacted at a temperature at 350° C. for 1 hour to produce a 95 to 100% dense preform billet. The billet was subsequently extruded at a temperature of 450° C. through a die to make a T-section article. FIG. 8 shows a photograph of a piece taken from a 15ft long T-section extrusion, demonstrating that the alloys of the present invention can be extruded into structural shapes like those typically used in airframe missile applications.

Having thus described the invention in rather full detail, it will be understood that these details need not be strictly adhered to but that various changes and modifications may suggest themselves to one skilled in the art, all falling within the scope of the invention as defined by the subjoining claims.

We claim:

1. A rapidly solidified aluminum-base alloy consisting essentially of the formula $Al_{bal}Fe_aSi_bX_c$, wherein X is at least one element selected from the group consisting of Mn, V, Cr, Mo, W, Nb, Ta, "a" ranges from 2.0 to 7.5 at %, "b" ranges from 0.5 to 3.0 at %, "c" ranges from 0.05 to 3.5 at % and the balance is aluminum plus incidental impurities, with the proviso that the ratio (Fe+X):Si ranges from about 2.0:1 to 5.0:1, said alloy having an aluminum solid solution phase containing therein a substantially uniform distribution of dispersed, intermetallic phase precipitates, each of said precipitates being of approximate composition $Al_{12}(Fe,X)_3Si$, measuring less than about 100nm in any dimension thereof and having a cubic structure.

2. An alloy as recited in claim 1, said alloy having been rapidly solidified in an ambient atmosphere at a quench rate of at least about $10^{5°}$ to $10^{7°}$ C./sec.

3. A method for forming a consolidate metal alloy article wherein particles composed of an aluminum-base alloy consisting essentially of the formula $Al_{bal}Fe_aSi_bX_c$, wherein X is at least one element selected from the group consisting of Mn, V, Cr, Mo, W, Nb, Ta, "a" ranges from 2.0 to 7.5 at %, "b" ranges from 0.5 to 3.0 at %, "c" ranges from 0.05 to 3.5 at % and the balance is aluminum plus incidental impurities, with the proviso that the ratio ranges from about 2.0:1 to 5.0:1 are heated in a vacuum to a temperature ranging from about 300 to 500° C. and compacted to form an aluminum solid solution phase containing therein a substantially uniform distribution of dispersed, intermetallic phase precipitates, each of said precipitates being of approximate composition $Al_{12}(Fe,X)_3Si$, measuring less than about 100 nm in any dimension thereof and having a cubic structure.

4. A method as recited in claim 3, wherein said heating step comprising heating said particles to a temperature ranging from 325° to 450° C.

5. A method for forming a consolidated metal alloy article wherein:

(a) particles composed of an aluminum-base alloy consisting essentially of the formula $Al_{bal}Fe_aSi_bX_c$, wherein X is at least one element selected from the group beginning of Mn, V, Cr, Mo, W, Nb, Ta, "a" ranges from 2.0 to 7.5 at %, "b" ranges from 0.5 to 3.0 at %, "c" ranges from 0.05 to 3.5 at % and the balance is aluminum plus incidental impurities, with the proviso that the ratio :Si ranges from about 2.0:1 to 5.0:1 are placed in a container, heated to a temperature ranging from about 300 to 500° C., evacuated and sealed under vacuum, and (b) said container and contents are heated to a temperature ranging from 300 to 500° C. and compacted to form an aluminum solid solution phase containing therein a substantially uniform distribution of dispersed, intermetallic phase precipitates, each of said precipitates being of approximate composition $Al_{12}(Fe,X)_3Si$, measuring less than about 100 nm in any dimension thereof and having a cubic structure.

6. A method as recited in claim 5, wherein said heating step comprises heating said container and contents to a temperature ranging from 325° C. to 450° C.

7. A consolidated metal article compacted from particles of an aluminum base alloy consisting essentially of the formula $Al_{bal}Fe_aSi_bX_c$, wherein X is at least one element selected from the group consisting of Mn, V, Cr, Mo, W, Nb, Ta, "a" ranges from 2.0 to 7.5 at %, "b" ranges from 0.5 to 3.0 at %, "c" ranges from 0.05 to 3.5 at % and the balance is aluminum plus incidental impurities, the ratio {Fe+X}:Si ranging from about 2.0:1 to 5.0:1, said consolidated article being composed of an aluminum solid solution phase containing therein a substantially uniform distribution of dispersed, intermetallic phase precipitates, each said precipitates being of approximate composition $Al_{12}(Fe,X)_3Si$, measuring less than about 100 nm. in any dimension thereof and having a cubic structure.

8. A consolidated metal article as recited in claim 7, wherein said article has the form of a sheet having a width of at least 0.5" and a thickness of at least 0.010".

9. A consolidated metal article as recited in claim 8, wherein said particles of aluminum-base alloy are compacted at a temperature of about 400 to 550° C. and each of the said dispersed intermetallic precipitates measure less than 500 nm. in any dimension thereof.

10. A consolidated metal article as recited in claim 7, wherein the volume fraction of said fine intermetallic precipitates ranges from about 10 to 50%.

11. A consolidated metal article as recited in claim 7, wherein said article is compacted by forging without substantial loss of its mechanical properties.

12. A consolidated metal article as recited in claim 7, wherein said article is compacted by extruding through a die into balk shapes.

* * * * *

UNITED STATES PATENT AND TRADEMARK OFFICE

CERTIFICATE OF CORRECTION

PATENT NO. : 4,878,967

DATED : Nov. 7, 1989

INVENTOR(S) : C.M. Adam et al.

It is certified that error appears in the above-identified patent and that said Letters Patent is hereby corrected as shown below:

Col. 2, line 23: Before "substance" add -- solid --.

Col. 3, line 15: After "as-cast" delete -- ( --.

Col. 7, line 38: Just above Table 3: "temperature of 1 hr." should read -- temperature for 1 hr. --.

Col. 10, line 3: "of present" should read -- of the present --.

line 45: "After "ratio" insert -- [Fe + X]:Si --.

line 55: "comprising" should read -- comprises --.

Col. 11, line 4: "beginning" should read -- consisting --.

line 8: "ratio :Si" should read -- ratio [Fe + X]:Si--.

Signed and Sealed this

Twenty-fourth Day of September, 1991

*Attest:*

HARRY F. MANBECK, JR.

*Attesting Officer*

*Commissioner of Patents and Trademarks*